United States Patent [19]

Lochmann et al.

[11] 3,951,046

[45] Apr. 20, 1976

[54] PUSH ROD AND TAPPET ASSEMBLY

[75] Inventors: Robert L. Lochmann, Grand Blanc; Daniel C. MacManus, Owosso, both of Mich.

[73] Assignee: General Motors Corporation, Detroit, Mich.

[22] Filed: May 10, 1974

[21] Appl. No.: 468,757

[52] U.S. Cl. ..... 92/113; 92/94; 92/100; 92/129; 417/471; 29/525

[51] Int. Cl.[2] ..... F16J 3/00; F01B 19/00

[58] Field of Search ..... 92/129, 101, 60.5, 72, 92/113, 94, 100, 128; 29/156.4 WL, 156.4 R, 156.5 R, 156.5 A, 525; 417/471

[56] References Cited

UNITED STATES PATENTS

| | | | |
|---|---|---|---|
| 1,783,940 | 12/1930 | Trumble | 92/129 |
| 1,899,295 | 2/1933 | Schulze | 92/129 |
| 2,018,153 | 10/1935 | Schulze | 92/129 |
| 3,328,870 | 7/1967 | Rabinovich et al. | 29/525 |
| 3,793,704 | 2/1974 | Antonevich | 29/525 |

FOREIGN PATENTS OR APPLICATIONS

| | | | |
|---|---|---|---|
| 804,865 | 7/1949 | Germany | 29/525 |
| 83,220 | 4/1935 | Sweden | 417/471 |
| 412,858 | 7/1930 | United Kingdom | 417/471 |

*Primary Examiner*—Paul E. Maslousky
*Attorney, Agent, or Firm*—Arthur N. Krein

[57] ABSTRACT

A push rod and tappet assembly for a cam actuated pump in which a tappet having a barbed shank is lightly press fitted, during assembly, part-way into the hollow end of the push rod so that during the initial operating cycle of the pump, as the cam on which the tappet rides rotates through the first cycle of rotation, the pump piston to which the push rod is connected bottoms out and the shank of the tappet will then be forced further into the push rod to a position to thereafter provide substantially zero clearance in the pump.

4 Claims, 3 Drawing Figures

PUSH ROD AND TAPPET ASSEMBLY

This invention relates to an axial, self-adjusting shaft link for interconnecting light machine elements and, in particular, to an axial, self-adjusting pump push rod and tappet assembly to provide minimum piston head clearance in a pump.

Various mechanical mechanisms, such as pumps, compressors and similar devices, include elements adapted to be actuated through a mechanical linkage. In many cases, the limit position of an element or its range of movement must be accurately determined and adjusted with respect to some other element after the mechanism has been assembled. Such adjustments are usually relatively small and are required infrequently as when the mechanism is initially assembled or when parts are repaired or replaced. Accordingly, the adjustments are most conveniently made by varying a characteristic, such as the effective length of one of the elements or links constituting the linkage through which the mechanism is actuated.

One such mechanism, for example, is an engine driven air pump or compressor used in an automotive vehicle, the air pump or compressor being of the reciprocating piston type and having a push rod operatively connected thereto, the push rod being positioned to engage a suitable cam on an engine driven shaft whereby to effect reciprocating movement in at least one direction of the piston. As is well known, in such a pump or compressor, it is desirable to ideally have zero clearance between the piston and the housing at the top of the pumping stroke in order to obtain maximum pumping capacity out of the unit. However, obtaining near zero clearance is difficult to accomplish economically in such a pump during its assembly or during the assembly of the pump to its driver, especially if these assemblies are mass produced due to the stack-up tolerances both in the pump and in its driver.

It is therefore a primary object of this invention to provide an improved push rod and tappet assembly for a pump, compressor or similar device whereby the effective length of the push rod can be readily and automatically adjusted.

Another object of this invention is to provide a cam actuated, reciprocating, piston type pump or compressor with a push rod and tappet assembly, whose length can be varied automatically during the first operating cycle of the pump to effect near zero clearance between the piston and the pump housing.

A further object of this invention is to provide a push rod and tappet assembly for a pump or compressor, the effective length of which can be readily decreased without the aid of any tools, and which can be economically manufactured.

These and other objects of the invention are obtained by a push rod and tappet assembly for a cam actuated pump or compressor in which a splined or barbed cam follower or tappet is press fitted part-way into a suitably formed aperture in the push rod for the pump whereby, during pump operation, the tappet can be forced further into the push rod as the piston of the pump bottoms out to adjust the length of this assembly so as to provide substantially zero clearance between the piston and its housing.

For a better understanding of the invention, as well as other objects and further features thereof, reference is had to the following detailed description of the invention to be read in connection with the accompanying drawings, wherein.

Figure 1:
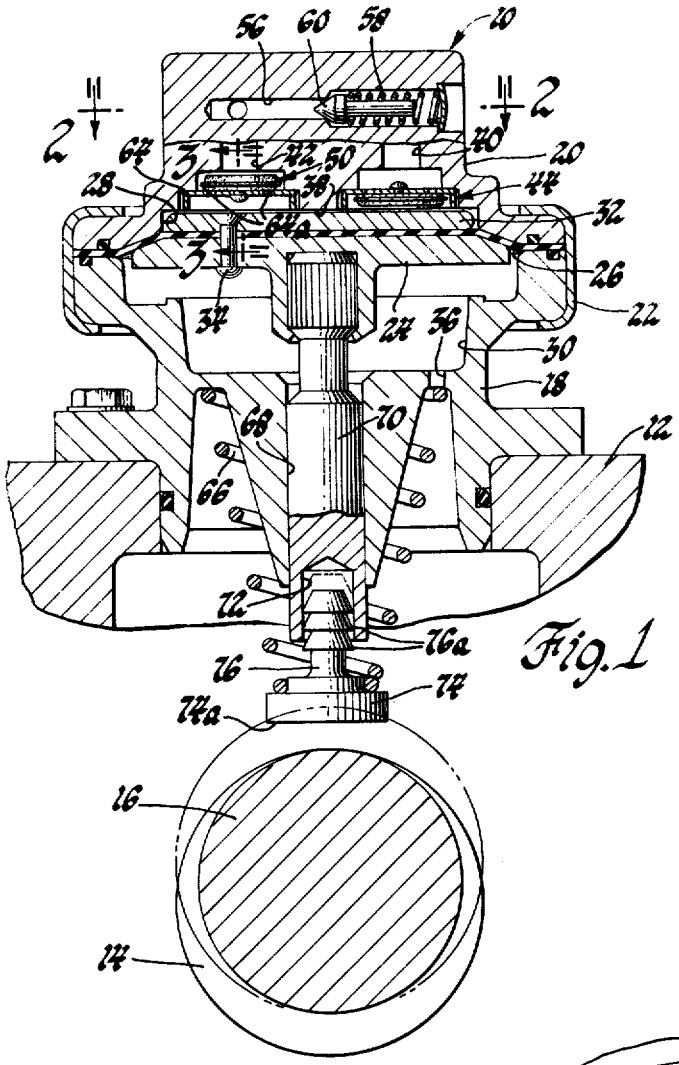
FIG. 1 is a sectional view of a cam actuated, reciprocating, piston-diaphragm type, engine driven air pump having a push rod and tappet assembly in accordance with the invention.

Although the push rod and tappet assembly of the invention can be used in various types of mechanical mechanisms, for purposes of illustration, this assembly is shown as incorporated in an engine driven, reciprocating, piston type compressor or air pump, generally designated 10, for an automotive vehicle, the push rod and tappet assembly, in accordance with the invention, providing an operative connection between the piston of the pump shown and the rotary cam actuator for the pump. As shown in FIG. 1, the pump 10 is suitably secured to a fixed member, such as engine housing element 12, in position to be actuated by the eccentric or cam 14 on an engine driven shaft 16, which shaft could also be suitably supported for rotation by a portion of the housing element 12.

Air pump 10 has a two-piece pump housing which includes a lower housing 18 and an upper housing 20 suitably secured together, as by a crimping ring 22, to provide a piston receiving annular cylinder or cavity therein to receive a reciprocating, cylindrical piston 24 and a diaphragm 26 as part of the piston element for the pump. The annular, outer, peripheral edge portion of the diaphragm 26 is sealingly sandwiched between the lower housing 18 and the upper housing 20. The central portion of the diaphragm 26 is fixed to the piston 24 for movement therewith, as by being sandwiched between the face of the piston 24 and a diaphragm protector disc 32, these elements being secured together as by a plurality of circumferentially spaced apart rivets 34, only one of which is shown. The piston 24, diaphragm 26 and disc 32 define a piston-diaphragm assembly or piston which is operable to divide the cylinder or cavity in the pump housing into a pair of variable volume chambers including a pumping or upper chamber 28 and an atmospheric or lower chamber 30, with reference to FIG. 1.

The atmospheric or lower chamber 30 is always in direct communication with the atmosphere through suitable apertures, such as apertures 36, only one being shown, provided for this purpose in the lower housing 18. The pumping or upper chamber 28 is defined in part by the movable diaphragm 26 and diaphragm protector disc 32 and, in part, by the fixed, counterbored end wall 38 of upper housing 20, this end wall 38 corresponding to a cylinder head end wall and has inlet and outlet ports 40 and 42, respectively, therein, which are provided to extend axially in the upper housing 20.

Figure 2:
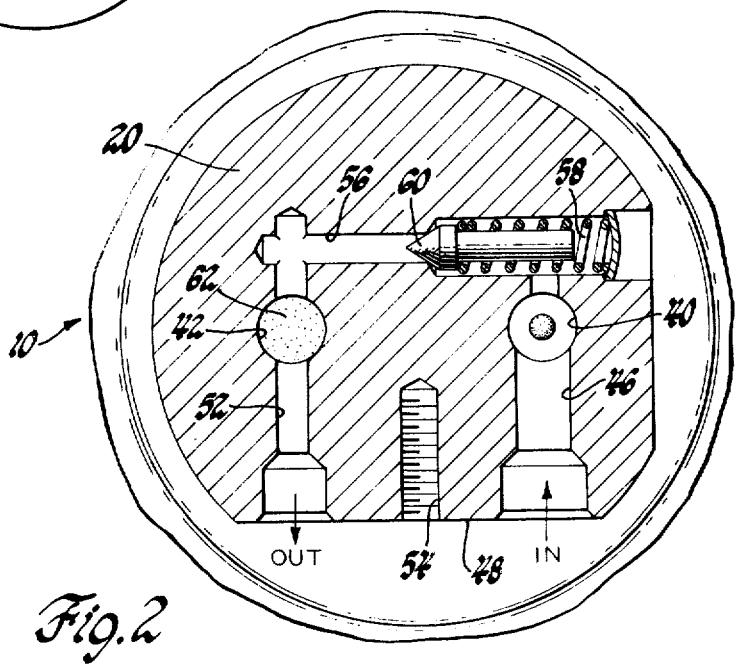
FIG. 2 is an enlarged view taken along line 2—2 of FIG. 1.

Inlet port 40 in the upper housing 20 is formed at one end thereof as a stepped bored passage adjacent to the end wall 38 whereby to receive and support an inlet valve 44 and, at its other end, the inlet port 40 connects with an inlet passage 46 extending radially outward through the mounting pad 48 on one side of the upper housing, as seen in FIG. 2. In a similar manner, outlet port 42 is formed at one end to receive and support a discharge valve 50 and at its other end connects with an outlet passage 52 also extending radially outward through the mounting pad 48 in spaced relation to the inlet passage 46. The mounting pad 48 of the upper housing 20 is provided with a threaded bore 54 intermediate the passages 46 and 52 to receive the fastener of a conventional two-tube mounting block, not shown, whereby the air pump can be operatively connected to other elements of a system, not shown, of which the air pump forms a part.

The outlet port 42 is also connected to the inlet port 40 by a pressure release passage 56, the flow through which is controlled by a spring 58 biased pressure release valve 60.

Figure 3:
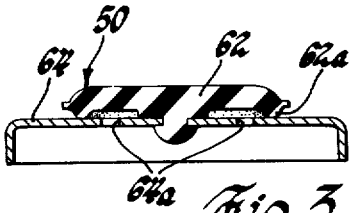
FIG. 3 is an enlarged view of the discharge valve for the air pump taken along line 3—3 of FIG. 1.

As seen in FIG. 3, the discharge valve 50 includes a valve disc 62, made of suitable flexible material, such as rubber, suitably fixed at its center to a cup-shaped valve retainer 64 in a manner whereby its annular sealing ring portion 62a is normally biased into sealing engagement with a surface of the retainer 64 radially outward of the circumferentially, spaced apart, arcuate shaped, flow passages 64a extending through the retainer. The inlet valve 44 is similar in construction to the discharge valve 50, except that on the inlet valve 44, the valve disc 62 is positioned on the underside of the valve retainer 64.

Referring now to the subject matter of the invention, the mechanism for effecting an operative connection between the piston 24 of the air pump 10 and the cam 14 on engine driven shaft 16 is a variable length piston or push rod including a push rod 70 and tappet 74 telescopically assembled together in accordance with the invention. The push rod 70 of this assembly may be formed integral with the piston 24 or, as shown, it may be formed as a separate element suitably fixed at one end to the piston 24. Push rod 70 is intermediate its ends slidably received in a bore 68 extending through the lower housing 18 and has its free or other end extending axially outward from the lower housing 18. This free end of the push rod 70 is provided with a coaxial bore 72 of a predetermined size and length to receive, in a manner to be described, the tappet or cam follower 74. Tappet 74, in the embodiment shown, is provided with an enlarged, flanged follower portion **74*a* for engagement with the cam 14 and with an integral shank 76 extending from and concentric with the follower portion 74*a*. The assembly of the push rod and tappet, with the tappet engaging the cam 14 as it is rotated, is used to effect axial movement of the piston in one direction and, axial movement of the piston in the opposite direction is effected by a conical compression spring 66 abutting at one end against the lower housing 18 and at its other end operatively engaging the push rod 70, as by engagement with the tappet 74, fixed in a manner to be described, to the push rod. Spring 66 would normally bias the tappet of the push rod-tappet assembly downward into engagement with the cam 14, but this normal position is not shown in FIG. 1 because, for a purpose which will become apparent, the piston is actually shown at the top of its stroke in a bottom out position in the pump housing. In this position, there should ideally be zero or substantially zero clearance between the piston and the head end wall 38. In FIG. 1,** a clearance is shown between these elements for the purpose of illustration only.

The diameter of bore 72 in the push rod 70 and the outer diameter of the shank 76 of the tappet 74 should be sized relative to each other so that the shank 76 can be inserted with a press fit into the bored end of the push rod 70 and then thereafter moved in one direction axially relative to the push rod by the force of the cam 14 during its rotation acting against the tappet and with the push rod then fixed axially as when the piston-diaphragm assembly bottoms out during the first operational cycle of the pump. However, the press fit of the tappet into the end of the push rod should be such as to prevent axial movement of these elements relative to each other during a pumping stroke as a result of the fluid pressure in the pumping chamber 28 acting on the piston-diaphragm assembly. In other words, the bore in the end of the push rod and the shank of the follower should be sized so that these elements are frictionally attached but are capable of telescopic movement under a certain condition, as when a predetermined axial force is applied against these elements. The axial force necessary to effect movement of the shank of the tappet axially further into the bore of the push rod should be of predetermined value above the normal force applied to these elements as a result of the operating pressure capacity of the pump whereby the push rod and tappet can telescope relative to each other to reduce their effective length, in the manner to be described, but otherwise the forces acting axially on these elements during normal pump operation will not effect either a reduction or an increase in the overall length of these two elements although they are only frictionally attached together. Preferably, the shank of the tappet is either radially splined or, as shown, provided with axially spaced barbs **76*a*** which will provide a good frictional interference fit in the bored end of the push rod with the least acceptable amount of compressive force in the push rod.

The tappet 74 is initially assembled to the push rod 70 by pressing the shank 76 portion of it only part-way into the bored 72 end of the push rod 70 so that the original assembled length of these two elements is greater than that normally required for operation of the air pump. Thus, with reference to FIG. 1, with the piston-diaphragm assembly shown in the bottom out position at the top of the compression stroke within the cylinder of the pump housing and, with substantially zero clearance between this piston assembly and the end wall 38 of the pumping chamber 28, the as assembled overall length of the push rod and tappet should be such that the cam engaging surface of the follower portion **74*a* of the tappet 74 actually extends below the high point of the cam 14 during rotation of this cam and, as shown, its cam engaging surface, in this thus assembled position, should be at or above the low point of the cam. This assembly of the pump and driver should be made with the high point of the cam positioned approximately 180° away from the tappet, the position of the cam 14 shown by solid line in FIG. 1.**

As thus assembled, when the cam 14 is first rotated from the solid line position shown to effect the first pumping cycle of the air pump, as the high point of the cam is rotated toward the position in which its high point would engage the tappet, the position of cam 14 shown by broken line in FIG. 1, the rising portion of this cam will engage the tappet and force the push rod 70 and the piston axially upward until the piston bottoms out, the position shown in FIG. 1, and then, since the push rod is then momentarily axially fixed, the shank 76 of the tappet will be forced further into the bored end of the push rod to thereby effect a shortening of the overall length of the push rod and tappet assembly to a length whereby to provide substantially zero clearance between the piston-diaphragm assembly and the cylinder head portion of the upper housing of the air pump as the high point of the cam 14 passes under the tappet. The effective length of the push rod 70 and tappet 74 assembly is now fixed due to their frictional engagement with each other to carry the piston during succeeding pumping cycles with minimum clearance between it and the cylinder wall 38 at the top of the pumping stroke. As the high point of the cam 14 rotates away from the tappet 74, the spring 66 will effect movement of the piston and push rod assembly in the opposite direction, this movement being limited by the fall of the cam as reflected by the biased engagement of the tappet against this cam.

Although not shown, it should be realized that, if desired, the push rod could telescope into the tappet instead of the tappet into the push rod, as shown, it only being necessary that these elements be frictionally attached in a manner whereby their effective length can be reduced only upon the application of a predetermined force during the first operating cycle of the pump. In addition, although spring 66 is shown as seated at one end on the tappet 74, it should be realized that, instead, it could seat on the push rod 70, if desired, as by providing a radial flange, not shown, for this purpose on the push rod.

What is claimed is:

1. A push rod and tappet assembly for use in a cam actuated pump mechanism including a housing means providing a pump cavity with a piston means movably positioned in the pump cavity and a cam rotatably positioned adjacent the housing means, said push rod and tappet assembly including a push rod having an axial extending bore of a predetermined diameter and length in one end thereof adapted to be journalled in the housing and fixed at its other end to the piston means and, a tappet having a shank integral therewith, a portion of said shank being in press fit engagement part-way in said bore of said push rod to provide a push rod and tappet assembly of a predetermined as assembled length, said tappet being adapted to be further axially moved in said bore upon the application of a predetermined axial applied force against said tappet relative to said push rod to a position providing a push rod and tappet assembly having a working length which is less than said as assembled length, said tappet as press fitting to said push rod being adapted to be engaged by the cam.

2. In combination, a reciprocal pump mechanism including a housing means providing a cylindrical cavity with a piston means reciprocal therein and a rotating cam to effect reciprocal movement of said piston means in at least one direction toward a bottom out position of said piston means in said cylindrical cavity, and a variable length push rod assembly of a predetermined as assembled length operatively connecting said cam to said piston means, said push rod assembly having telescoping portions actuated by the force of said cam when said piston means bottoms out in said cylindrical cavity against said housing means to adjust and set the effective working length of said push rod assembly during the first rotational cycle of said cam, said as assembled length being larger than said working length.

3. The combination of claim 2 wherein said push rod assembly includes a push rod with an axial bore at one end and a cam follower having an axial extending barbed shank positioned in said bore of said push rod in press fit relationship therewith.

4. A self-adjusting push rod assembly for a mechanism having an element positioned in the cylinder of a housing for reciprocal movement therein between a first position and a bottom out position relative to the housing by said push rod assembly engaging at one end said element and at its other end engaging a rotatable eccentric to effect movement of said push rod assembly in one direction to move said element from said first position to said bottom out position and by spring means operatively connected to said element to effect movement of said element from said bottom out position toward said first position, said push rod assembly including a push rod operatively connected at one end to said element and having an axial bore opening at its other end and, a follower operatively engaging said eccentric and having an axial extending shank portion positioned part-way into said bore opening of said push rod in press fit relationship therewith to provide a push rod assembly of an as assembled length, the as assembled length of said push rod and said follower being greater than the nominal interconnecting length between said eccentric and said element when in the bottom out position as moved thereto through rotation of said eccentric whereby during the first operational cycle of said mechanism by said eccentric, said element will bottom out and then said eccentric will force said shank of said follower axially further into said push rod to effect adjustment of the overall length of said push rod and said follower to a working length with near zero clearance between said element and said housing in the bottom out position of said element in said housing, said working length being less than said as assembled length.

* * * * *